US007380879B2

(12) United States Patent
Fletcher et al.

(10) Patent No.: US 7,380,879 B2
(45) Date of Patent: Jun. 3, 2008

(54) SELF-LEVELING FURNITURE LEG FOOT

(75) Inventors: Scott L. Fletcher, Redondo Beach, CA (US); Jamie Toland, Russellville, AR (US)

(73) Assignee: Virco Mgmt. Corporation, Torrance, CA (US)

( * ) Notice: Subject to any disclaimer, the term of this patent is extended or adjusted under 35 U.S.C. 154(b) by 0 days.

(21) Appl. No.: 11/554,446

(22) Filed: Oct. 30, 2006

(65) Prior Publication Data

US 2008/0100120 A1 May 1, 2008

(51) Int. Cl.
*A47B 91/00* (2006.01)
*A47B 91/04* (2006.01)

(52) U.S. Cl. ..... 297/270.1; 297/270.5; 297/448.2; 248/188.8; 248/188.9; 16/42 R

(58) Field of Classification Search ..... 297/448.2, 297/270.1, 270.5, 272.4; 248/188.8, 188.9; 16/42 R See application file for complete search history.

(56) References Cited

U.S. PATENT DOCUMENTS

| | | | | |
|---|---|---|---|---|
| 1,719,435 | A | 7/1929 | Lowther | |
| 3,076,221 | A | 2/1963 | Reynolds | |
| 3,640,496 | A * | 2/1972 | Duncan | 248/188.9 |
| 3,871,783 | A * | 3/1975 | Vogler | 248/188.9 X |
| 4,632,356 | A * | 12/1986 | Munz | 248/188.4 X |
| 4,763,868 | A * | 8/1988 | Teich | 248/188.8 X |
| 5,794,912 | A * | 8/1998 | Whittaker et al. | 248/188.4 X |
| 6,119,989 | A * | 9/2000 | Hollington et al. | 248/188.2 |
| 6,349,907 | B1 | 2/2002 | Hollington et al. | |
| 6,520,459 | B2 * | 2/2003 | Burr | 248/188.8 X |
| 6,604,784 | B1 * | 8/2003 | Bosman et al. | 297/448.2 X |
| 6,626,405 | B1 * | 9/2003 | Keast et al. | 248/188.9 |
| 6,719,256 | B2 * | 4/2004 | Rydell et al. | 248/188.9 X |
| 6,742,750 | B2 * | 6/2004 | Burr | 248/188.8 X |
| 6,869,052 | B2 * | 3/2005 | Keast et al. | 248/188.9 |
| 6,883,763 | B2 | 4/2005 | Bosman et al. | |
| 6,910,666 | B2 * | 6/2005 | Burr | 248/188.8 X |
| 7,147,284 | B2 * | 12/2006 | Mills et al. | 297/270.1 X |
| 2003/0209925 | A1 * | 11/2003 | Bosman et al. | 297/239 |

* cited by examiner

*Primary Examiner*—Rodney B. White
(74) *Attorney, Agent, or Firm*—Sheldon Mak Rose & Anderson PC; Denton L. Anderson; Robert M. Hupe

(57) ABSTRACT

A furniture leg foot includes (a) a body adapted for attachment to a lower portion of a furniture leg, the body having a longitudinal axis and being made from a first material; and (b) one or more resilient inserts disposed within the body, the one or more resilient inserts being made from a resilient material which is softer than the first material.

17 Claims, 4 Drawing Sheets

SELF-LEVELING FURNITURE LEG FOOT

FIELD OF THE INVENTION

This invention relates generally to furniture having support legs and, more specifically, to feet for attachment to such support legs.

BACKGROUND OF THE INVENTION

Items of furniture are very often supported above the floor by a plurality of support legs, with a foot attached at the lowermost end of each such support leg. Typically, each foot is made from a rubber, plastic or similar material designed to minimize damage to the floor and to minimize the propensity of the item of furniture to skid along the floor.

Most such feet comprise a foot pad having a lower planar surface surrounded by a foot pad perimeter. To minimize damage caused to the floor and to minimize the propensity of the item of furniture to skid along the floor, it is important that the lower foot pad surface be disposed flat against the floor, rather than having only an edge disposed in contact with the floor. When an item of furniture is supported solely by the edge of the foot pad on one of its support leg feet, the pressure forces created against the floor along that edge can cause damage to the floor. Moreover, where an item of furniture is supported solely by an edge on one of its feet, the lack of surface contact between the floor and that foot pad allow the foot to be easily skidded along the floor.

Manufacturing furniture such that the foot pads of the feet supporting the furniture are always disposed flat against the floor is not easily accomplished. This is especially the case where the legs are downwardly disposed at an angle with respect to the vertical, such as in many tables and chairs. In such items of furniture, manufacturers find it difficult to assure that the foot pads on each of the furniture legs rests flat against the floor, because in the manufacturing process it is difficult to assure that the angle of the support legs does not vary from item to item.

The problems associated with trying to ensure that the foot pads of furniture support feet are disposed flat against a floor is a considerable problem where the item of furniture is a chair having sled-type legs. Such sled legs have a downwardly directed portion and a laterally directed, lowermost portion. The downwardly directed portion is attached to the laterally directed, lowermost portion at an elbow. The laterally directed, lowermost portion is disposed horizontally proximate to a floor surface. Feet for each sled leg usually comprises a pair of feet, one attached at the elbow of the sled leg and one attached to the terminal of the laterally directed, lowermost portion. Typically, such sled legs are splayed outwardly from the seating surface towards the floor. Such disposition of the sled legs makes it exceedingly difficult to provide feet for the sled legs which consistently are disposed flat against the surface of the floor.

Accordingly, there is a need for an improved furniture leg foot which minimizes the above-described problems in the prior art.

SUMMARY

The invention satisfies this need. The invention is a furniture leg foot comprising (a) a body adapted for attachment to a lower portion of a furniture leg, the body having a longitudinal axis and being made from a first material; and (b) one or more resilient inserts disposed within the body, the one or more resilient inserts being made from a resilient material which is softer than the first material.

DRAWINGS

These and other features, aspects and advantages of the present invention will become better understood with reference to the following description, appended claims and accompanying drawings where:

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well.

Figures 1, 2:
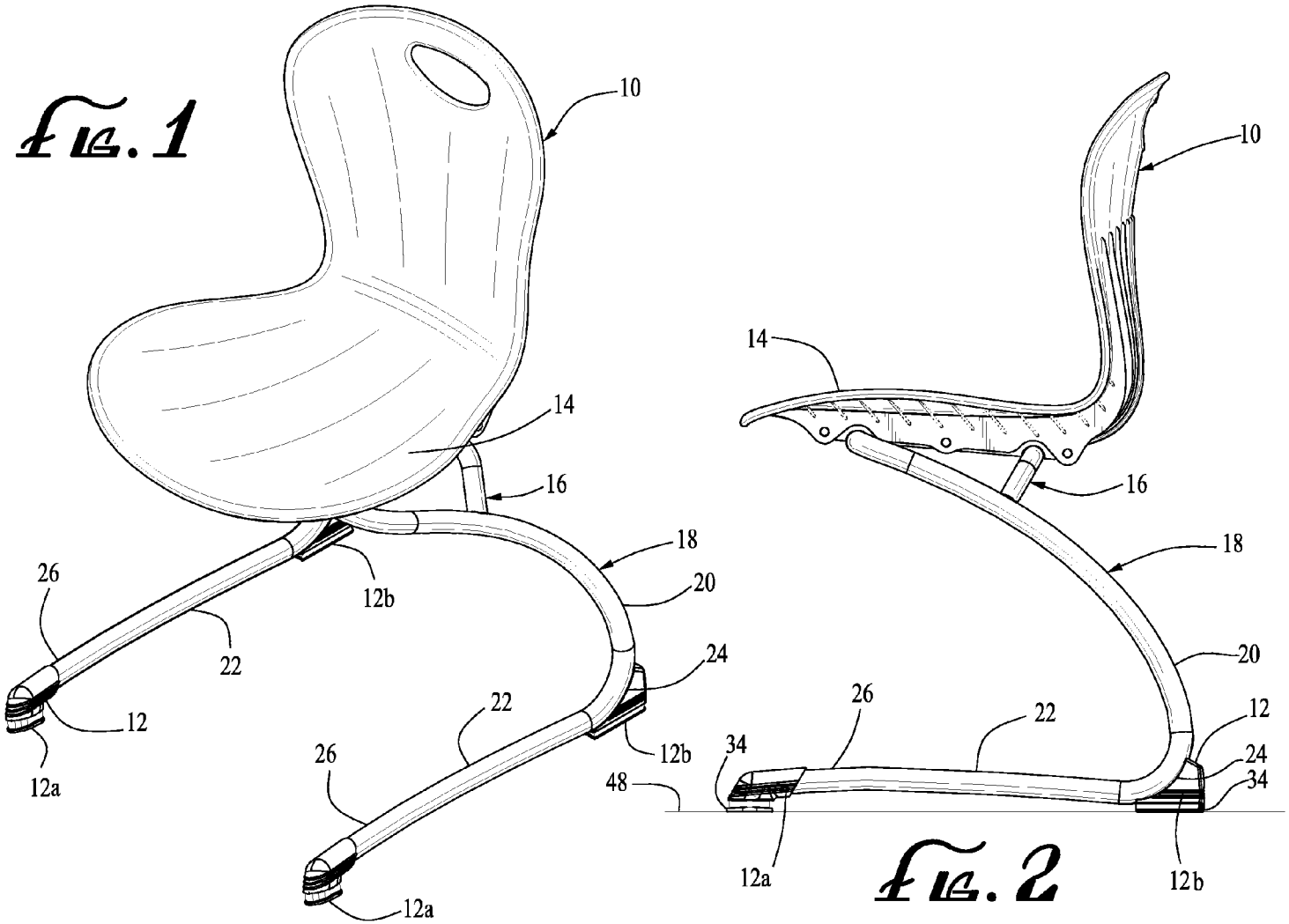
FIG. 1 is a perspective view of a chair having features of the invention.
FIG. 2 is a side view of the chair illustrated in FIG. 1.
Figures 3, 4, 5, 6, 7, 8:
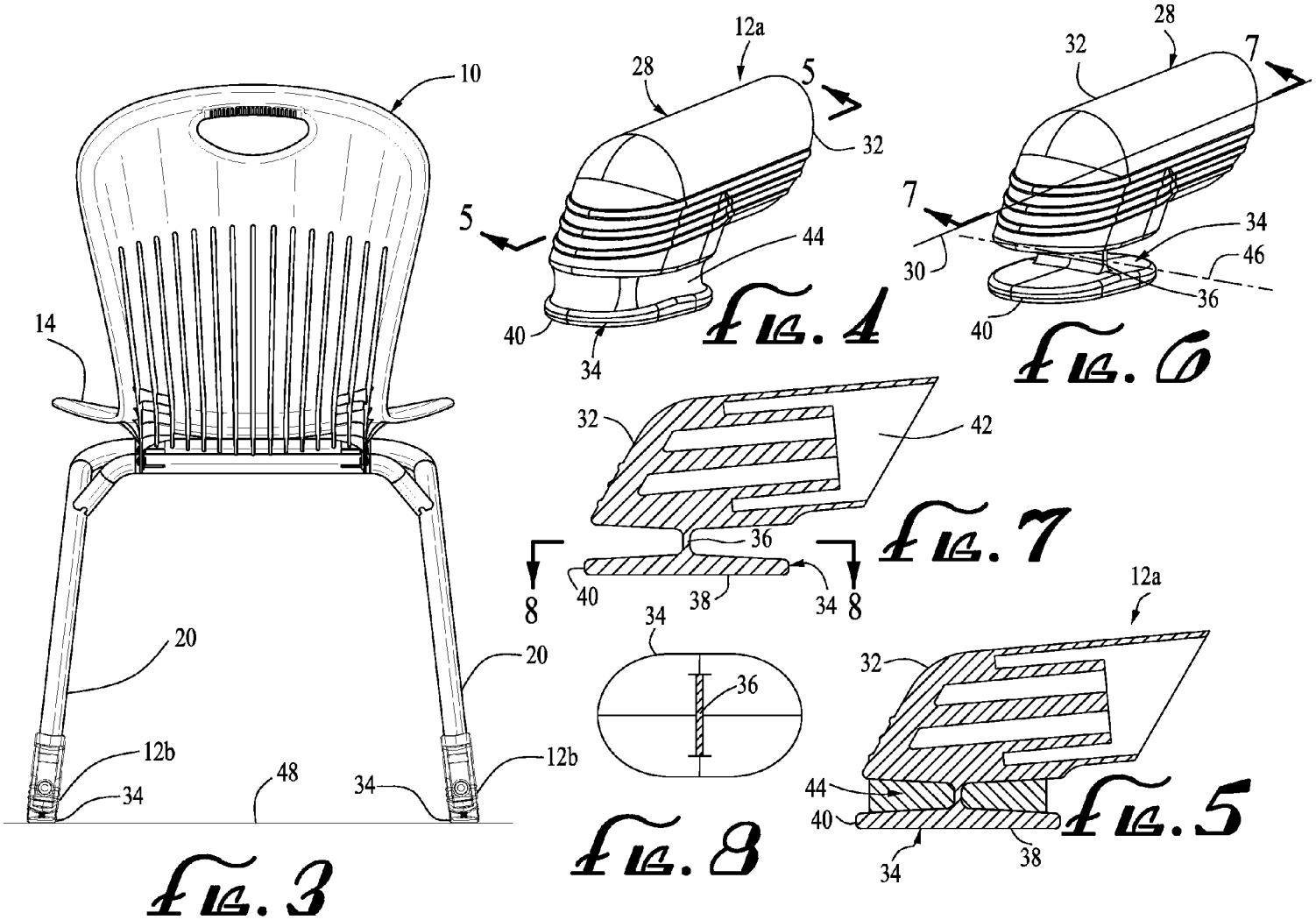
FIG. 3 is a rear view of the chair illustrated in FIG. 1.
FIG. 4 is a perspective view of a first chair foot having features of the invention.
FIG. 5 is a cross-sectional side view of the chair foot illustrated in FIG. 4.
FIG. 6 is a perspective view of a portion of the chair foot illustrated in FIG. 4.
FIG. 7 is a cross-sectional side view of the chair foot portion illustrated in FIG. 6.
FIG. 8 is a cross-sectional bottom view of the chair foot portion illustrated in FIG. 6.

Referring to the appended drawings, FIGS. 1-3 illustrate a chair 10 having chair feet 12 of the invention. The chair 10 comprises a seating surface 14 and a support structure 16 for supporting the seating surface 14 at an elevated plane. The support structure 16 comprises a pair of sled legs 18, each having a downwardly directed portion 20 and a laterally directed, lowermost portion 22. The downwardly directed portion 20 is attached to the laterally directed, lowermost portion 22 at an elbow 24. Each laterally directed, lowermost portion 22 terminates at a terminal end 26.

Attached to the chair 10 are four feet 12. A first chair foot 12*a* is attached to the terminal end 26 of each laterally directed, lowermost portion 22 of each sled leg 18. A second chair foot 12*b* is attached to the elbow 24 of each sled leg 18.

Both chair feet 12 are of a unique design. Both chair feet 12 comprise a body 28 adapted for attachment to a lower portion of a furniture leg. The body 28 has a longitudinal axis 30 and is made from a first material which is relatively strong such as polypropylene. Both chair feet 12*a* and 12*b* also comprise a resilient insert 44 made from a second material which is softer than the first material. Examples of such softer material include thermoplastic elastomers having a Shore A durometer between about 25 and about 55.

FIGS. 4-9 illustrate the first chair foot 12*a* in detail. In this embodiment, the body 28 comprises an upper portion 32 and a foot pad portion 34. The upper portion 32 is attached to the foot pad portion by a web 36. The foot pad portion 34 comprises a generally planar lower foot pad surface 34 which is surrounded by a foot pad perimeter 40. The thickness of the web 36 is typically between about 0.05 inch and about 0.2 inch, where the material of the web 36 is polypropylene.

The body 28 defines a bore 42 which is disposed generally parallel to the foot pad surface 34, and is adapted to accept the terminal end 26 of a laterally directed, lowermost portion 22 of a sled leg 18.

Figure 9:
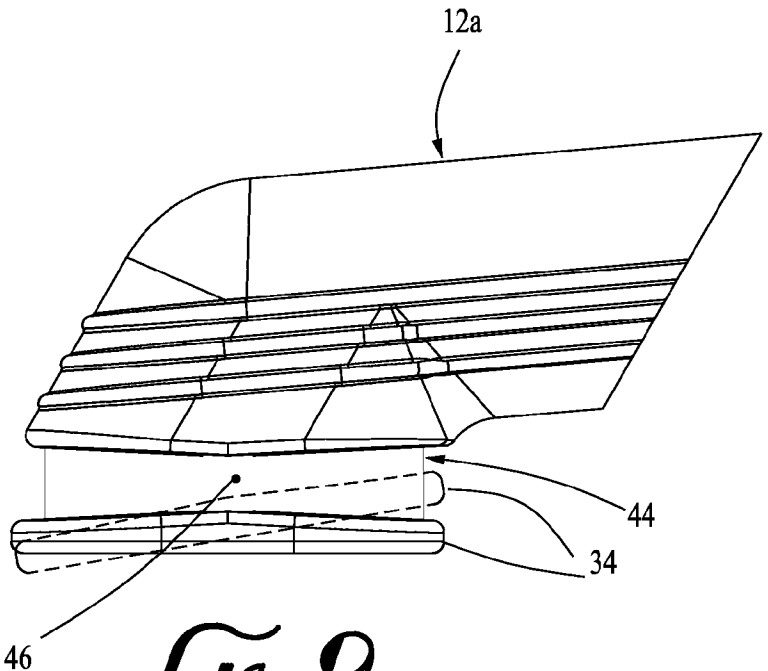
FIG. 9 is a side view of the chair foot illustrated in FIG. 4.
Figure 10:
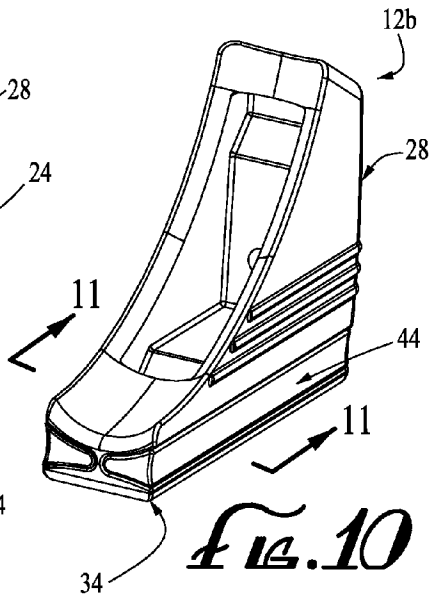
FIG. 10 is a perspective view of a second chair foot having features of the invention.
Figure 11:
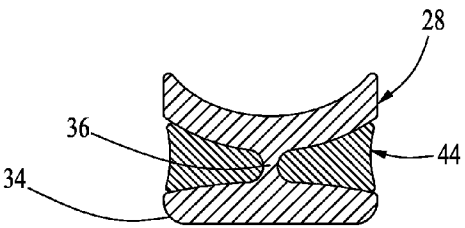
FIG. 11 is a cross-sectional end view of the chair foot illustrated in FIG. 10.

The upper portion 32 of the body 28 is spaced apart from the foot pad portion 34 by a distance of between about 0.07 inch and about 0.5 inch. In the space between the upper portion 32 of the body 28 and the foot pad portion 34 is disposed a resilient insert 44 as illustrated in FIGS. 4, 5 and 9. Because the material of the resilient insert 44 is softer than the materials from which the body 28 is made, and because the web 36 is relatively thin, the resilient insert 44 can compress by at least 0.001 inch when a rotational force is applied to the body 28 about an axis of rotation 46 disposed perpendicular to the longitudinal axis 30 of the body 28. This is illustrated in FIGS. 6 and 9. Because of this feature, the first foot 12*a*, when disposed at the terminal end 26 of a laterally directed, lowermost portion 22 of a sled leg 18, will always be disposed flat against a floor or other flat surface 48.

Figure 13:
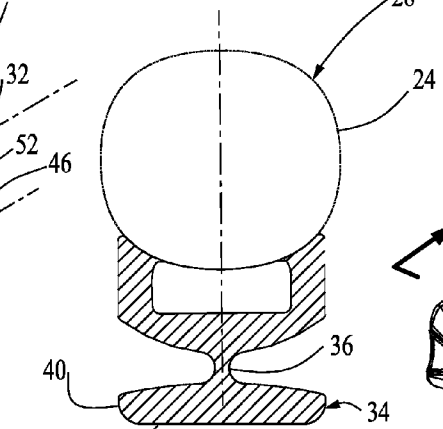
FIG. 13 is a cross-sectional end view of the chair foot portion illustrated in FIG. 12.
Figure 12:
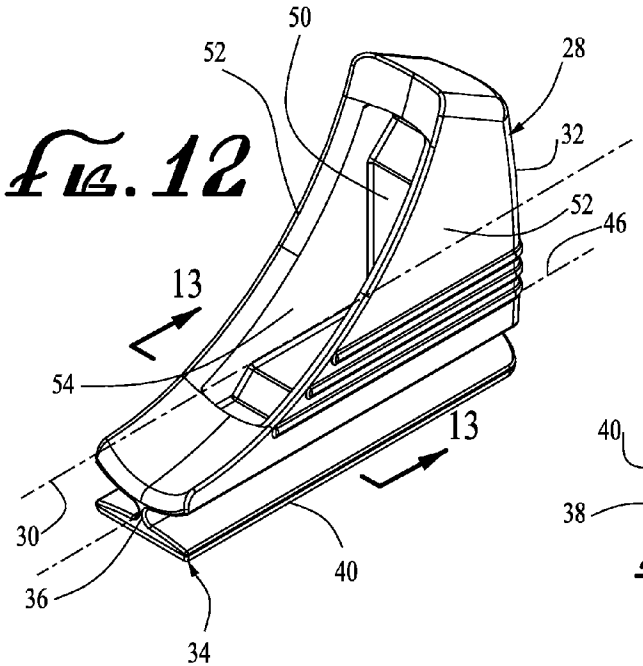
FIG. 12 is a perspective view of a portion of the chair foot illustrated in FIG. 10.

FIGS. 10-14 illustrate the second chair foot 12*b*. Like the first chair foot 12*a*, the second chair foot 12*b* comprises a body 28 made from a relatively strong and rigid material. The body 28 of the second chair foot 12*b* also comprises an upper portion 32 and a foot pad portion 34 connected together by a web 36. Unlike the foot 12 illustrated in FIGS. 4-9, the web 36 in the embodiment illustrated in FIGS. 12-13 is disposed parallel to the longitudinal axis 30 of the body 28. The thickness of the web 36 is typically between about 0.05 inch and about 0.2 inch, where the material of the web 36 is polypropylene.

In the second chair foot 12*b*, the upper portion 32 of the body 28 is spaced apart from the foot pad portion 34 by a distance of between about 0.05 inch and about 0.375 inch. Like in the first chair foot 12*a*, in the second chair foot 12*b* the space between the upper portion 32 of the body 28 and the foot pad portion 34 is filled with a resilient insert 44. The material forming such resilient insert 44 is softer than the material from which the body 28 is manufactured.

In the second chair foot 12*b*, the upper portion 32 of the body 28 comprises a back wall 50 and a pair of opposed side walls 52 which define an elongate opening 54 capable of receiving the elbow 24 of a chair leg. A screw hole 56 is defined in the back wall 50 to facilitate attachment of the second chair foot 12*b* to the elbow 24 of a sled leg 18.

Figure 14:
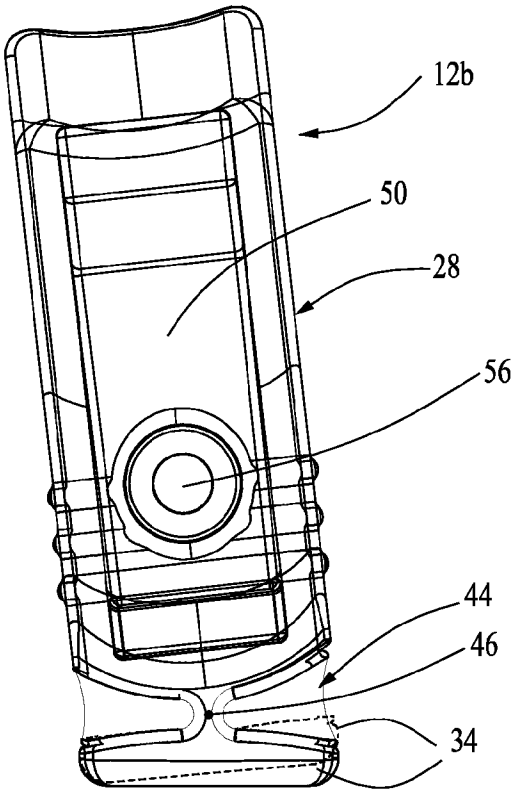
FIG. 14 is an end view of the chair foot illustrated in FIG. 10.

Because the resilient insert 44 in the second chair foot 12*b* is made from a material which is softer than the material from which the body 28 is manufactured, and because the web 36 is relatively thin, the resilient insert 44 is capable of compressing by at least 0.001 inch when a rotational force is applied to the body 28 about an axis of rotation 46 disposed parallel to the longitudinal axis 30. This is illustrated in FIGS. 12 and 14. This feature allows the web 36 of the foot 12 to always be disposed flat against a floor or other flat surface 48, even when the sled leg 18 is disposed at a slight angle with respect to the vertical.

Although the feet 12 of the invention have been described as being adapted to support a chair 10 having sled legs 18, those of ordinary skill in the art will recognize that the feet 12 of the invention can otherwise be adapted to support other items of furniture and other styles of chairs having downwardly directed legs which terminate at a terminal end 26. In all such cases, the feet 12 of the invention allow the web 36 to be maintained flat against a floor or other flat surface 48 upon which the item of furniture is disposed.

The invention provides an effective and inexpensive method of assuring that the foot pads 34 of furniture leg feet 12 automatically become disposed flat against a floor or other flat surface 48, thereby minimizing damage to the floor or surface and thereby minimizing the tendency of the item of furniture to skid along the floor or surface.

Having thus described the invention, it should be apparent that numerous structural modifications and adaptations may be resorted to without departing from the scope and fair meaning of the instant invention as set forth hereinabove.

What is claimed is:

1. A chair foot comprising:

(a) a body adapted for attachment to a lower portion of a leg on an item of furniture, the body having a longitudinal axis, an upper portion and a foot pad portion, the foot pad portion comprising a generally planar lower foot pad surface, the upper portion of the body being separated from the foot pad portion by a distance of between about 0.05 inch and about 0.5 inch, the body being made from a first material; and (b) one or more resilient inserts disposed between the upper portion of the body and the foot pad portion, the one or more resilient inserts being made from a resilient material which is softer than the first material;

wherein, when the chair foot is attached to a lower portion of a non-vertical leg on an item of furniture, and when the item of furniture is disposed on a floor or other flat surface, the one or more resilient inserts flex so that the foot pad portion is disposed flat against the floor or other flat surface.

2. The chair foot of claim 1 wherein the one or more resilient inserts are disposed within the body such that at least one of the one or more inserts compresses by at least 0.001 inch when a rotational force is applied to the body about an axis of rotation disposed parallel to the longitudinal axis.

3. The chair foot of claim 2 wherein the body comprises attachment means for attaching the body to the elbow of a chair leg.

4. The chair foot of claim 1 wherein the one or more resilient inserts are disposed within the body such that at least one of the one or more inserts compresses by at least 0.001 inch when a rotational force is applied to the body about an axis of rotation disposed perpendicular to the longitudinal axis.

5. The chair foot of claim 4 wherein the chair foot comprises a foot pad having a generally planar lower surface and wherein the body defines a bore which is disposed generally parallel to the lower surface of the foot pad.

6. An item of furniture comprising:

(a) a plurality of downwardly directed non-vertical support legs; and (b) a chair foot attached to at least one of the support legs;

wherein the chair foot comprises (i) a body adapted for attachment to a lower portion of the leg of the item of furniture, the body having a longitudinal axis, an upper portion and a foot pad portion, the foot pad portion comprising a generally planar lower foot pad surface, the upper portion of the body being separated from the foot pad portion by a distance of between about 0.05 inch and about 0.5 inch, the body being made from a first material; and (ii) one or more resilient inserts disposed between the upper portion of the body and the foot pad portion, the one or more resilient inserts being made from a resilient material which is softer than the first material;

wherein, when the chair foot is attached to a lower portion of a non-vertical leg on an item of furniture, and when the item of furniture is disposed on a floor or other flat surface, the one or more resilient inserts flex so that the foot pad portion is disposed flat against the floor or other flat surface.

7. A chair comprising:

(a) a seating surface;

(b) a support structure for supporting the seating surface at an elevated plane, the support structure comprising a plurality of non-vertical chair legs, each having a downwardly directed portion and a terminal end;

(c) a chair foot attached to the terminal end of at least one of the chair legs;

wherein the chair foot comprises (i) a body adapted for attachment to the terminal end of a chair leg, the body having a longitudinal axis, an upper portion and a foot pad portion, the foot pad portion comprising a generally planar lower foot pad surface, the upper portion of the body being separated from the foot pad portion by a distance of between about 0.05 inch and about 0.5 inch, the body being made from a first material; and (ii) one or more resilient inserts disposed between the upper portion of the body and the foot pad portion, the one or more resilient inserts being made from a resilient material which is softer than the first material;

wherein, when the chair foot is attached to a lower portion of a non-vertical leg on the chair, and when the chair is disposed on a floor or other flat surface, the one or more resilient inserts flex so that the foot pad portion is disposed flat against the floor or other flat surface.

8. A chair comprising:

(a) a seating surface;

(b) a support structure for supporting the seating surface at an elevated plane, the support structure comprising a pair of non-vertical sled legs, each having a downwardly directed portion and a laterally directed, lower-most portion, the downwardly directed portion being attached to the laterally directed, lower-most portion at an elbow, the laterally directed, lower-most portion having a terminal end;

(c) a first chair foot attached to the elbow of each sled leg; and (d) a second chair foot attached to the terminal end of each laterally directed, lower-most portion of each sled leg;

wherein both the first chair foot and the second chair foot comprise (i) a body adapted for attachment to a lower portion of the leg of the chair, the body having a longitudinal axis, an upper portion and a foot pad portion, the foot pad portion comprising a generally planar lower foot pad surface, the upper portion of the body being separated from the foot pad portion by a distance of between about 0.05 inch and about 0.5 inch, the body being made from a first material; and (b) one or more resilient inserts disposed between the upper portion of the body and the foot pad portion, the one or more resilient inserts being made from a resilient material which is softer than the first material;

wherein, when the chair foot is attached to the elbow of a chair leg, and when the chair is disposed on a floor or other flat surface, the one or more resilient inserts flex so that the foot pad portion is disposed flat against the floor or other flat surface.

9. The chair of claim 8 wherein the one or more resilient inserts in each first chair feet are disposed within the body of each first chair foot such that at least one of the one or more resilient inserts compresses by at least 0.001 inch when a rotational force is applied to the body about an axis of rotation disposed parallel to the longitudinal axis of the first chair foot.

10. The chair of claim 8 wherein the one or more resilient inserts disposed within the body of each second chair foot are attached to the terminal end of each laterally directed, lower-most portion of each sled leg such that at least one of the inserts compresses by at least 0.001 inch when a rotational force is applied to the body about an axis of rotation disposed perpendicular to the longitudinal axis of the second chair foot.

11. The chair foot of claim 1 wherein both the first material and the second material are plastics.

12. The chair foot of claim 1 wherein the first material is polypropylene.

13. The chair foot of claim 1 wherein the second material is a thermoplastic elastomer.

14. The chair foot of claim 1 wherein the second material is a thermoplastic elastomer having a Shore A durometer between about 25 and about 55.

15. The chair foot of claim 1 wherein the first material is polypropylene and the second material is a thermoplastic elastomer.

16. The chair foot of claim 1 wherein the upper portion of the body is connected to the foot pad by a web having a thickness between about 0.05 inch and about 0.2 inch, the web being disposed generally perpendicular to the longitudinal axis of the body.

17. The chair foot of claim 1 wherein the upper portion of the body is separated from the foot pad portion by a distance of between about 0.05 inch and about 0.375 inch, the web being disposed generally parallel to the longitudinal axis of the body.

* * * * *